US008096928B2

(12) United States Patent
Ovadia

(10) Patent No.: US 8,096,928 B2
(45) Date of Patent: Jan. 17, 2012

(54) DEVICE FOR TREATING THE LOWER BACK

(76) Inventor: Izhuk Ovadia, New York, NY (US)

( * ) Notice: Subject to any disclaimer, the term of this patent is extended or adjusted under 35 U.S.C. 154(b) by 0 days.

(21) Appl. No.: 12/612,144

(22) Filed: Nov. 4, 2009

(65) Prior Publication Data

US 2011/0034306 A1 Feb. 10, 2011

Related U.S. Application Data

(60) Provisional application No. 61/273,531, filed on Aug. 5, 2009.

(51) Int. Cl.
*A63B 21/05* (2006.01)
*A61H 39/04* (2006.01)

(52) U.S. Cl. ..... 482/123; 482/130; 482/142; 601/24

(58) Field of Classification Search ..... 482/79, 482/91, 92, 121–123, 125, 128–130, 134, 482/142, 145, 904, 907; 297/230.13, 230.14, 297/301.4, 303.4, 383, 423.4; 601/24, 90, 601/98, 134
See application file for complete search history.

(56) References Cited

U.S. PATENT DOCUMENTS 1,182,854 A 5/1916 Poler
1,215,609 A * 2/1917 Arnold ..... 297/354.12
1,518,361 A * 12/1924 Ruden ..... 482/128
1,548,849 A * 8/1925 Ruden ..... 482/128
1,703,779 A * 2/1929 Pujals ..... 297/301.4
1,732,116 A * 10/1929 Boller ..... 297/383
2,060,298 A * 11/1936 Gailey ..... 297/230.13
2,427,053 A * 9/1947 Hampton ..... 601/98
2,582,115 A * 1/1952 Goodeve ..... 297/230.11
2,786,512 A * 3/1957 Moyer ..... 297/122
4,162,807 A 7/1979 Yoshimura
5,050,875 A * 9/1991 Lewkovich ..... 482/128
5,368,367 A * 11/1994 Titchener et al. ..... 297/423.4
5,421,800 A * 6/1995 Mullen ..... 482/121
5,954,399 A 9/1999 Hong
6,261,213 B1 * 7/2001 Frey ..... 482/121
6,402,246 B1 6/2002 Mundell
6,716,144 B1 * 4/2004 Shifferaw ..... 482/140
6,918,634 B2 7/2005 Elliot
7,011,369 B2 3/2006 Massara et al.
7,137,933 B2 * 11/2006 Shifferaw ..... 482/121
7,344,194 B2 3/2008 Maier et al.
7,578,797 B2 * 8/2009 Hazard ..... 601/103
7,803,097 B2 * 9/2010 Araujo ..... 482/142
2006/0040803 A1 * 2/2006 Perez ..... 482/112
2006/0116262 A1 * 6/2006 Pandozy ..... 482/142

* cited by examiner

*Primary Examiner* — Loan Thanh
*Assistant Examiner* — Victor K Hwang
(74) *Attorney, Agent, or Firm* — Sofer & Haroun, LLP

(57) ABSTRACT

An arrangement for treatment of the back having a base, a backrest, a footplate and a spring arrangement. The spring arrangement is disposed against the backrest so that when a user sits on the seat, and presses against the footplate, the lower back of the user is pressed against the spring arrangement.

12 Claims, 8 Drawing Sheets

DEVICE FOR TREATING THE LOWER BACK

RELATED APPLICATION

This application claims the benefit of priority from U.S. Provisional Patent Application No. 61/273,531, filed on Aug. 5, 2009, the entirety of which is incorporated by reference.

BACKGROUND

1. Field of the Invention

This application relates to a therapeutic device. More particularly, this application relates to a therapeutic device for treating the lower back.

2. Description of Related Art

There are many health issues that may arise with the human back/spine, particularly with respect to the lower back or lumbar region of the spine. Many support devices, such as those incorporated into the backs of chairs, are capable of providing additional support to prevent the onset of lower back discomfort. However, even with these devices lower back pain afflicts many individuals.

Treatments for lower back pain are myriad including pain medications, supports/braces, heat pads, as well as physical treatments including massage therapy. However, these treatment methods may be expensive, less than completely effective and may often require additional persons to implement (such as with massage treatments).

OBJECTS AND SUMMARY

The present invention provides a device for the treatment of lower back pain that is simple to operate, of inexpensive construction, portable and capable of providing an effective treatment.

To this end, the device includes, among other elements a plurality of springs mounted to a stable surface with the springs positioned perpendicular to the plane of the back. Opposite the springs and platform is a plate allowing the user to place the feet thereon to press backwards against the springs, causing the perpendicularly oriented springs to press into the lower back providing a deep massaging action.

BRIEF DESCRIPTION OF THE DRAWINGS

The present invention can be best understood through the following description and accompanying drawings, wherein.

DETAILED DESCRIPTION

Figure 1:
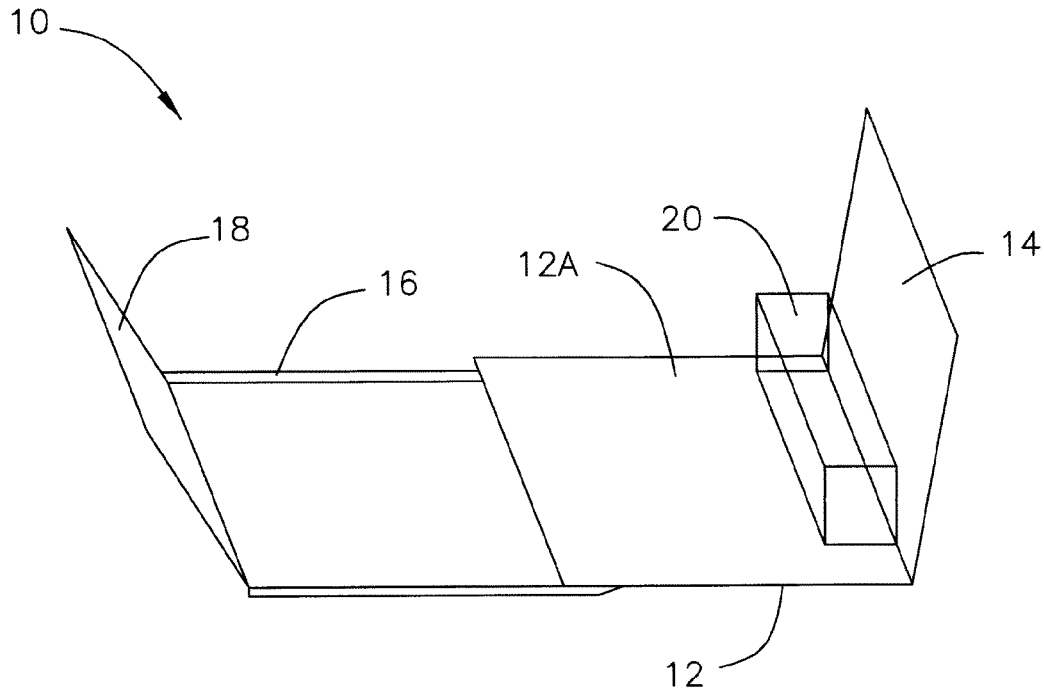
FIG. 1 shows a back treatment device in accordance with one embodiment.

FIG. 1 shows the device 10 according to a first embodiment. A base 12 and back rest 14 portion are made from a stable light weight material such as aluminum or a rigid polymer. Ideally, an upper surface 12*a* of base 12 is made from a surface with a low coefficient of friction to allow a user's posterior to slide/glide slightly without significant resistance.

Coupled to the end of base portion 12 are one or two rod like extensions 16, similarly made from rigid polymer or lightweight metals. At the end of rod extensions 16 is a foot plate 18, again constructed of similar materials. Foot plate 18 is preferably angled upward from rod extensions 16 and is configured to provide a pressing point for the user's feet as explained below.

Figure 2:
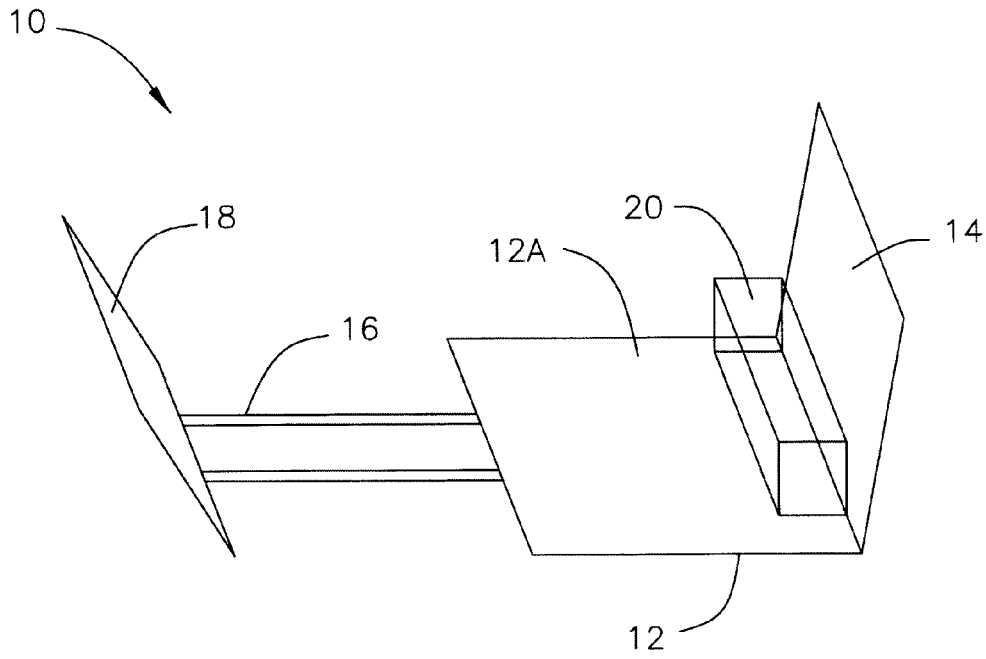
FIG. 2 shows an alternative arrangement of the back device of FIG. 1, in accordance with one embodiment.

As shown in FIG. 2, the single or double (as shown) rod extensions 16 may be located in the center between base 12 and foot plate 18 or they may be located along the lateral edges of base 12 as shown in FIG. 1.

Attached to the lower portion of back rest 14 is a spring arrangement 20. Spring arrangement 20 is configured to rest against a lower back region of a user sitting on base 12. Ideally, spring arrangement 20 is fixed to back rest 14 approximately ½" above base 12, but the invention is not limited in this respect.

Figure 3:
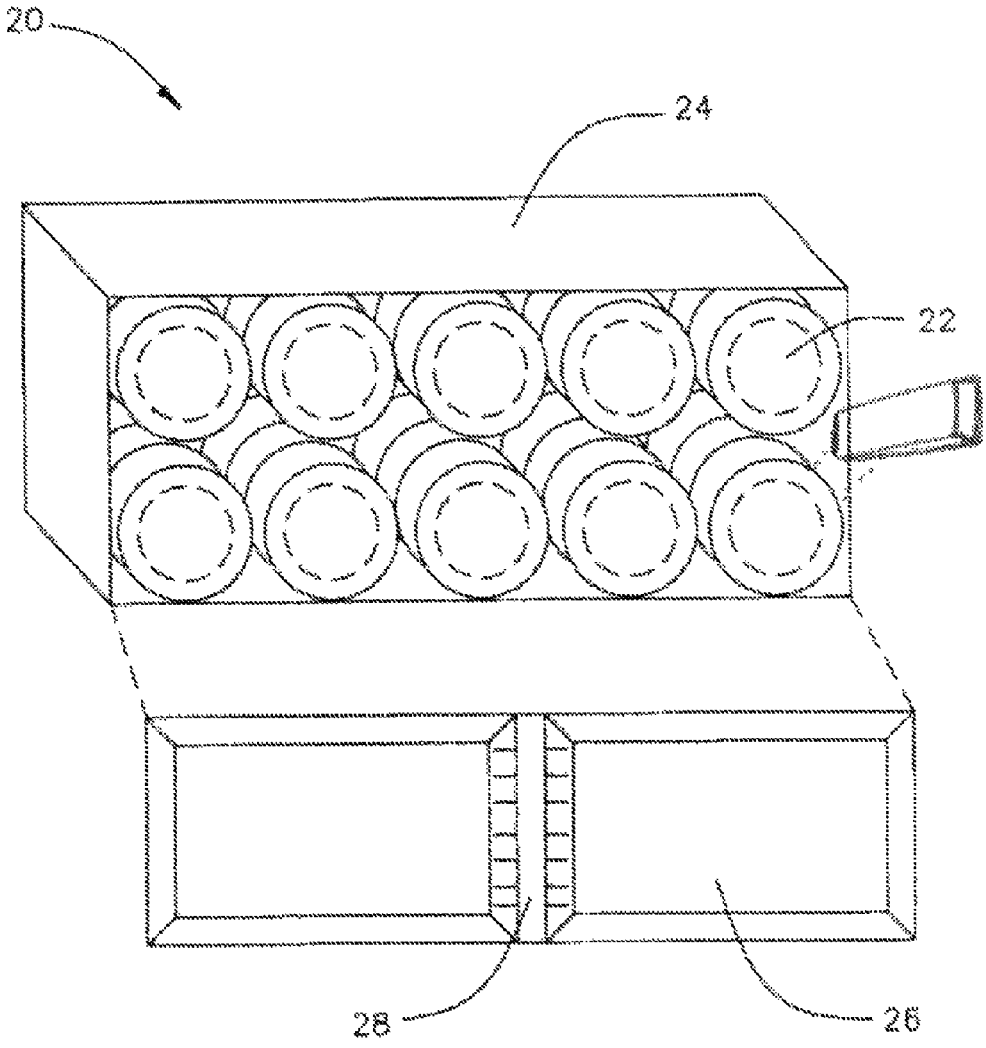
FIG. 3 shows an exploded view of the spring arrangement from the treatment device of FIG. 1, in accordance with one embodiment.

As shown in FIG. 3, spring arrangement 20 is preferably constructed of substantially ten coil type springs 22, arranged in two horizontal rows of five springs. However it is possible to use more or fewer springs 22 or different kinds of springs 22 provided that spring arrangement 20 is capable of providing the functions as discussed below.

For example, any one of Bonnell coils (hourglass-shaped), Marshall coils (wrapped in a fabric encasement), Offset coils (hinged) or Continuous coils (long row), and others coils typically used in mattresses may be used in various combinations. For exemplary purposes, springs 22 are described as typical hourglass shaped Bonnell coils.

As shown in FIG. 3, the ten springs 22 are organized within spring arrangement 20 so that they are substantially perpendicular to a user's back as shown in FIGS. 1 and 2. The height (horizontally aligned) of springs 22 are preferably between 4" and 10."

In one arrangement, each spring 22 is made from a coiled metal wire, such as a steel wire, using typical wire gauge ranges of AWG (American Wire Gauge) between 18 AWG (1.024 mm diameter) and 12.5 AWG (1.94 mm diameter). The tension of the springs is substantially consistent with stiff mattress springs. It is understood that for certain arrangements and tensions larger wire gauges may be used from 12 AWG up to 6 AWG to accommodate greater resistive forces and/or use by heavier individuals.

The spring constant (k) for springs 22, based on the AWG as noted above, is measured within the equation:

$$F=k(D_s-D_d)$$

where F=the Force applied k=spring constant $D_s$=length of spring standing $D_d$=length of spring deflected Measurements are made at 20% deflection and 80% deflection and averaged, assuming the spring constant is substantially constant over the center 60% of deflection (between 20% and 80%).

In the arrangement of the present application, springs 22 are preferably gauged and arranged, with the necessary spring constants (k) so that, as a unit, in spring arrangement 20 the springs may absorb between 222 -889 Newtons (50-200 lbs) based on the desired target user (ie. women may require less resistive springs, with larger heavier men requiring a higher resistance). Stronger springs with necessary spring constants (k) to absorb up to 1880 Newtons (400 lbs) may be used for heavier individuals or greater resistance for stronger individuals or for deeper desired massaging effects.

It is understood that these dimensions and force requirements are exemplary and not intended to limit the present invention.

The springs 22 of spring arrangement 20 are enclosed within a casing 24, such as a leather or polymer casing. Springs 22 within may be coupled to one another (eg. by welding) or may be independently arranged depending on the form of the coil.

In one arrangement, polymer or elastomer inserts or wedges may be used in conjunction with springs 22 so as to increase their compression resistance. In one manner, this may be used as fixed inserts so that they may permanently be incorporated into springs 22 allowing smaller springs to be used to greater affect, reducing the cost of device 10. In another manner, such inserts into springs 22 may be removable, ie accessible within an openable casing 24. This allows a user to adjust the compression force for one or more of springs 22.

On the front surface of casing 24, in the direction of the user's back, a rubber padding surface 26 is dimensioned to provide a smooth and semi-rigid surface for the user's back. Ideally, surface 26 is thick enough to prevent springs 22 from cutting the user, but thin enough to allow the individual springs' force to be felt through surface 26 on the user back for increased surface massage effect.

In one arrangement, the front padding surface 26 of spring arrangement 20 maintains a spine notch or channel 28. This allows the user to have the sides of their lower back supported against spring arrangement 20, without having the spine uncomfortably pressed directly against the springs.

Turning to the operation of the device, a user sits on base 12 and presses their feet against raised foot plate 18. Then the user presses their lower back into spring arrangement 20, with coiled springs 22 providing a massaging effect to the area.

Figure 4:
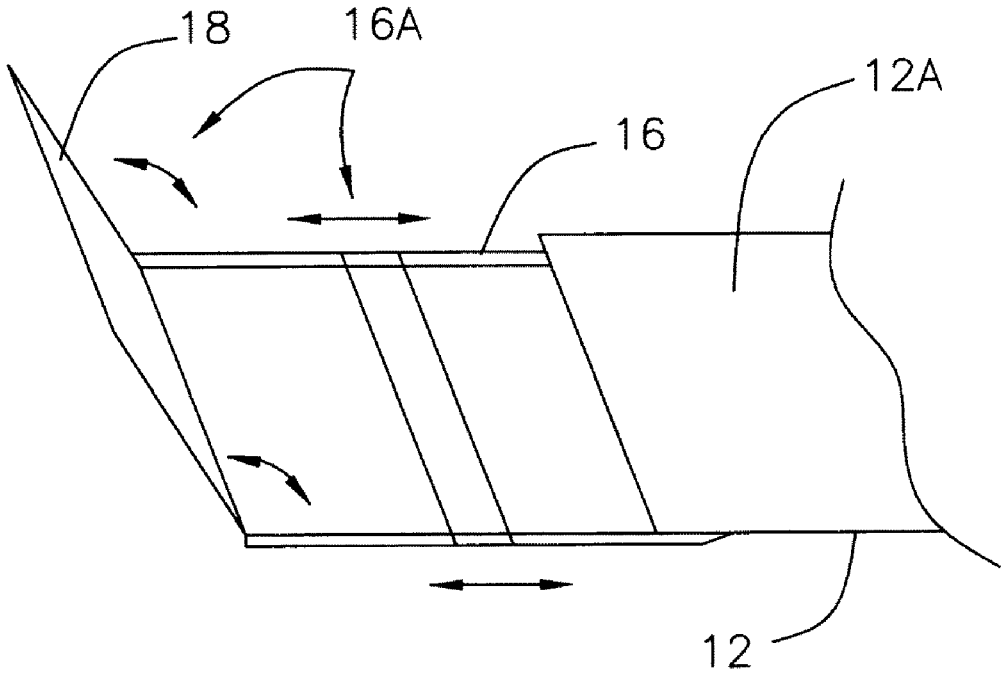
FIG. 4 shows an adjustable arrangement for the leg port of the treatment device of FIG. 1, in accordance with one embodiment.

In one arrangement, as shown in FIG. 4, the length of extension rod 16 and the angle of foot plate 18 are variable by an adjustment means 16A to allow the user to adjust these measurements. The angle of foot plate 18 and the length of extension rods 16 allow the user to adjust the distance to spring arrangement 20 to increase or decrease the amount of pressure they may apply with their back against spring arrangement 20.

Figure 5:
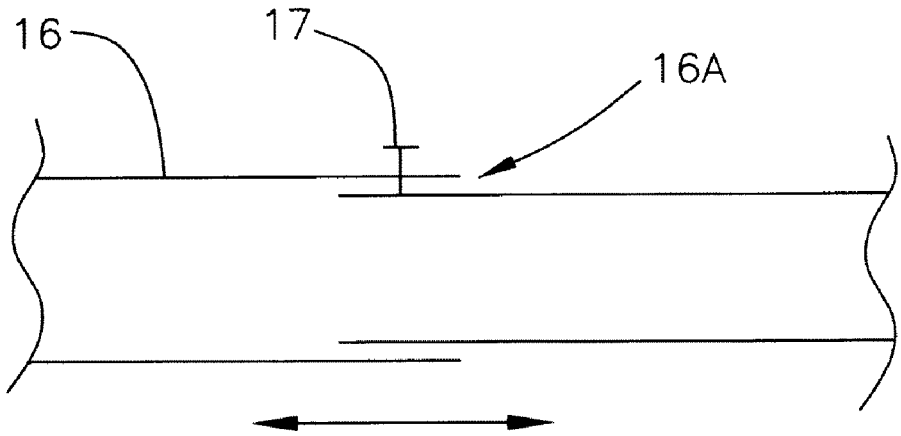
FIG. 5 shows a close up view of an extension arm from any one of FIGS. 1, 2 and 4 in accordance with one embodiment.

As shown in FIG. 5, adjustment means 16A of extension rods 16 may be made from a typical dual pipe and lock system where a first portion extension rod 16 fits within the circumference of another portion, with a locking means 17, such as screw clamp.

Figure 6:
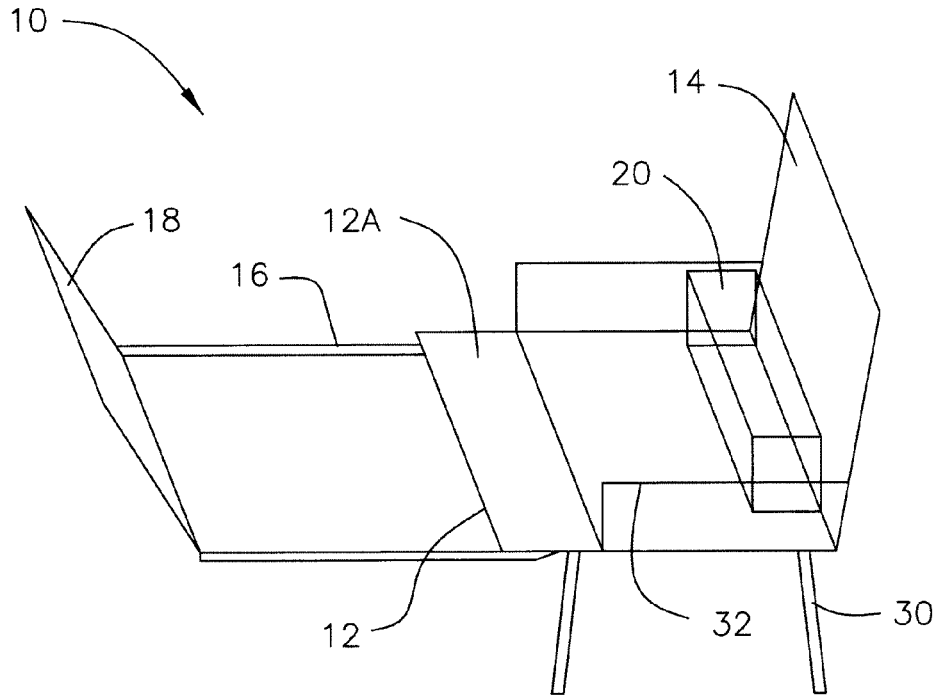
FIG. 6 shows an alternative arrangement of the back treatment device of FIG. 1 or 2, in accordance with one embodiment.

In another arrangement as shown in FIG. 6, device 10 as shown in FIG. 1, may be incorporated into a chair with the addition of legs 30, arm rests 32 etc. . . . . Otherwise, device 10 of FIG. 1 may simply be used on the floor.

Figure 7:
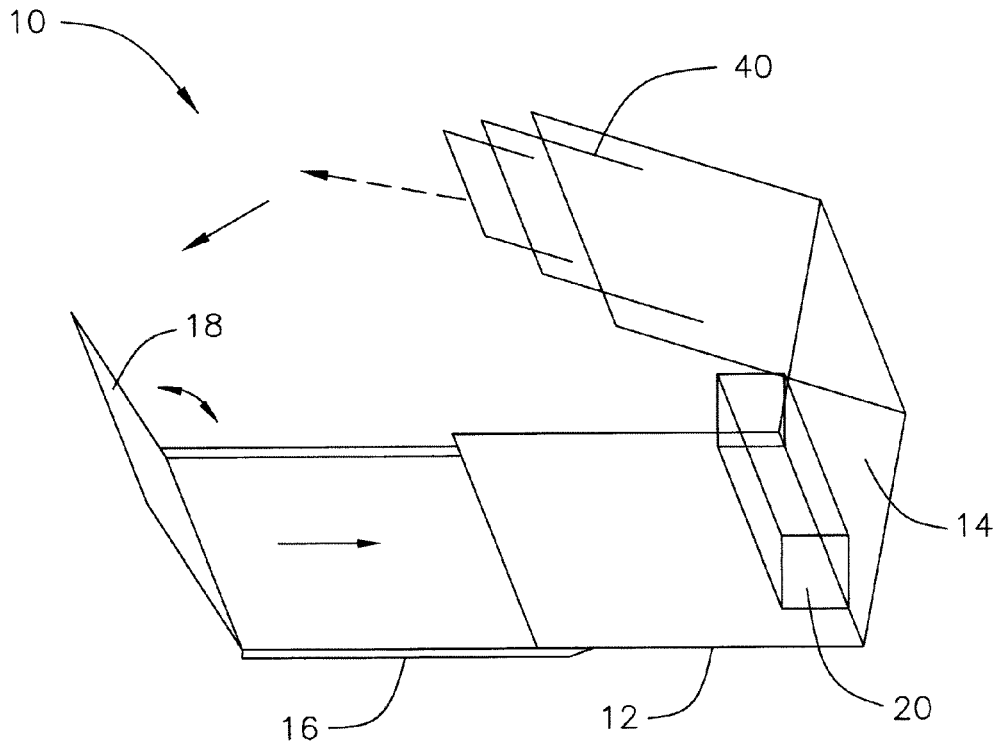
FIG. 7 shows an alternative arrangement of the back treatment device of FIG. 1 or 2 with a cover, in accordance with one embodiment.

In another arrangement as shown in FIG. 7, an optional telescoping over element 40 may be added to the top of back rest 14 so that when device 10 is not in use it may be folded down over base 12 and extension rods 16 to connect with the top of foot plate 18 to make the un-used device 18 look more aesthetically pleasing.

Figure 8:
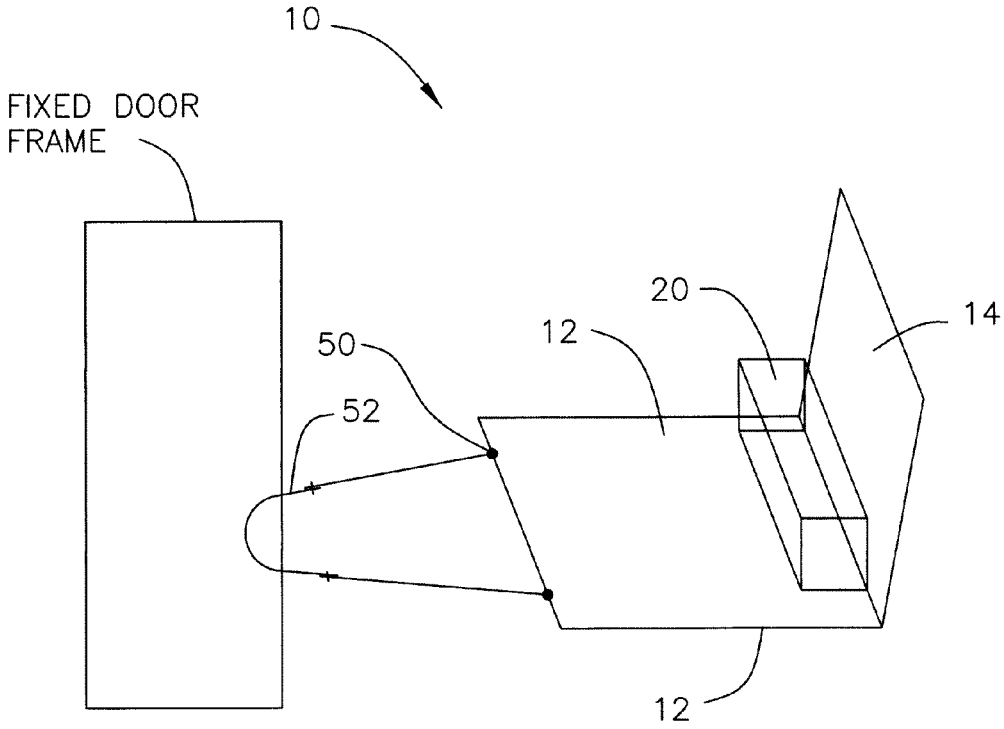
FIG. 8 shows an alternative arrangement of the back treatment device of FIG. 1 or 2 with an alternative support system, in accordance with one embodiment.

In another arrangement as shown in FIG. 8, extension rods 16 and foot plate 18 may be removable. Also base 12 and back rest 14 may be hinged relative to one another, and spring arrangement 20 may be removable so that device 10 may be folded for travel. An optional hook or hooks 50 may be found on the underside of seat 12 with a chain/rope hook 52 arrangement for attaching to a door frame or other fixed object. As an alternative, rubber suction (not pictured) may be used as an alternative to the hook and extension/foot plates.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. An arrangement for treatment of the back, said arrangement comprising:

a base, said base having an upper surface with a low coefficient of friction sufficient to allow a user's posterior to slide/glide slightly without significant resistance, said base being arranged in a substantially horizontal arrangement;

a backrest, said backrest being attached at a first end of said base, substantially perpendicular to said base, and in a substantially vertical arrangement;

a footplate attached at a second end of said base, substantially perpendicular to said base, and in a substantially vertical arrangement; and a spring arrangement, wherein said spring arrangement is disposed against said backrest above said base so that when a user sits on said base, and presses against said footplate, the posterior of the user glides along said upper surface of said base with the lower back pressing against said spring arrangement, wherein said springs are selected to have a spring constant (k) so that a force of 222-889 Newtons results in compression of said springs more than 20% deflections and less than 80% deflection when a user presses their feet into said footplate forcing their lower back along said upper surface of said base into said spring arrangement.

2. The arrangement as claimed in claim 1, further comprising at least one extension rod that couples said footplate to said base.

3. The arrangement as claimed in claim 2, wherein said extension rod is adjustable in length.

4. The arrangement as claimed in claim 1, wherein said spring arrangement, includes a plurality of springs with compression axes arranged substantially parallel to the upper surface of said base and perpendicular substantially to said backrest.

5. The arrangement as claimed in claim 4, wherein said springs are a plurality of coiled springs.

6. The arrangement as claimed in claim 5, wherein said springs are in the range of AWG 18 through AWG 12.5.

7. The arrangement as claimed in claim 5, wherein said springs are selected from the group consisting of Bonnell coils, Marshall coils, Offset coils and Continuous coils.

8. The arrangement as claimed in claim 4, wherein said spring arrangement includes a surface pad having first and second regions for engaging a user's lower back, said surface pad having a vertically oriented spine notch between said first and second regions, configured as a depression between said regions.

9. The arrangement as claimed in claim 8, wherein said surface pad is dimensioned with a thickness such that it protects a user's back from said spring arrangement while being simultaneously thin enough so that the individual force of each spring may be felt through said surface pad, to achieve a massaging effect.

10. The arrangement as claimed in claim 1, further comprising a cover element attached to a top of said backrest for covering over said arrangement to a top of said footplate.

11. The arrangement as claimed in claim 1, wherein said spring arrangement has one or more polymer or elastomer inserts or wedges used in conjunction with said springs so as to increase their compression resistance.

12. The arrangement as claimed in claim 11, wherein said inserts or wedges are accessible via an openable casing and removable allowing a user to adjust the compression force for one or more of said springs.

* * * * *